US007786069B2

(12) United States Patent
Tindel-Koukal et al.

(10) Patent No.: US 7,786,069 B2
(45) Date of Patent: Aug. 31, 2010

(54) MULTIPLE USE SOLID FABRIC CONDITIONING COMPOSITIONS AND TREATMENT IN A DRYER

(75) Inventors: Monica P. Tindel-Koukal, Burnsville, MN (US); Robert D. Hei, Baldwin, WI (US); Steven E. Lentsch, St. Paul, MN (US); Stephan M. Hubig, Maplewood, MN (US)

(73) Assignee: Ecolab Inc., St. Paul, MN (US)

( * ) Notice: Subject to any disclaimer, the term of this patent is extended or adjusted under 35 U.S.C. 154(b) by 359 days.

(21) Appl. No.: 11/823,872

(22) Filed: Jun. 28, 2007

(65) Prior Publication Data

US 2008/0004204 A1 Jan. 3, 2008

Related U.S. Application Data

(60) Continuation-in-part of application No. 11/401,656, filed on Apr. 10, 2006, now Pat. No. 7,250,393, which is a division of application No. 10/656,854, filed on Sep. 4, 2003, now Pat. No. 7,087,572, which is a continuation-in-part of application No. 10/120,891, filed on Apr. 10, 2002, now Pat. No. 7,381,697.

(51) Int. Cl.
*C11D 1/835* (2006.01)

(52) U.S. Cl. ..... 510/519

(58) Field of Classification Search ..... 510/519
See application file for complete search history.

(56) References Cited

U.S. PATENT DOCUMENTS

| | | | |
|---|---|---|---|
| 3,442,692 | A | 5/1969 | Gaiser |
| 3,632,396 | A | 1/1972 | Perez-Zamora |
| 3,634,947 | A | 1/1972 | Furgal |
| 3,650,816 | A | 3/1972 | Rudy et al. |
| 3,676,199 | A | 7/1972 | Hewitt et al. |
| 3,686,025 | A | 8/1972 | Morton |
| 3,796,599 | A | 3/1974 | McLaughlin |
| 3,804,330 | A | 4/1974 | Miller, Jr. et al. |
| 3,806,359 | A | 4/1974 | McLaughlin |
| 3,822,145 | A | 7/1974 | Liebowitz et al. |
| 3,870,145 | A | 3/1975 | Mizuno |
| 3,936,538 | A | 2/1976 | Marshall et al. |
| 3,947,971 | A | 4/1976 | Bauer |
| 3,948,387 | A | 4/1976 | Haertle |
| 3,963,629 | A | 6/1976 | McLaughlin |
| 3,967,008 | A | 6/1976 | Mizuno et al. |
| 3,972,131 | A | 8/1976 | Rudy et al. |
| 3,991,479 | A | 11/1976 | Dionne |
| 4,004,685 | A | 1/1977 | Mizuno et al. |
| 4,014,432 | A | 3/1977 | Clothier et al. |
| 4,035,307 | A | 7/1977 | Fry et al. |
| 4,041,205 | A | 8/1977 | Compa et al. |
| 4,053,992 | A | 10/1977 | Furgal |
| 4,085,052 | A | 4/1978 | Murphy et al. |
| 4,095,946 | A | 6/1978 | Jones et al. |
| 4,098,937 | A | 7/1978 | Mizuno et al. |
| 4,105,813 | A | 8/1978 | Mizuno |
| 4,134,838 | A | 1/1979 | Hooper et al. |
| 4,139,477 | A | 2/1979 | Hayek et al. |
| 4,142,978 | A | 3/1979 | Murphy |
| 4,149,977 | A | 4/1979 | Morganson et al. |
| 4,157,307 | A | 6/1979 | Jaeger et al. |
| 4,237,155 | A | 12/1980 | Kardouche |
| 4,252,656 | A | 2/1981 | Liebowitz et al. |
| 4,254,139 | A | 3/1981 | Hendrickson et al. |
| 4,308,159 | A | 12/1981 | Sprecker |
| 4,567,675 | A | 2/1986 | Rennie |
| 4,570,888 | A | 2/1986 | Evans |
| 4,733,774 | A | 3/1988 | Ping, III et al. |
| 4,749,596 | A | 6/1988 | Evans et al. |
| 4,753,389 | A | 6/1988 | Davis |
| 4,756,850 | A | 7/1988 | Nayar |
| 4,764,289 | A | 8/1988 | Trinh |
| 4,767,548 | A | 8/1988 | Kasprzak et al. |
| 4,769,159 | A | 9/1988 | Copeland |
| 4,818,569 | A | 4/1989 | Trinh et al. |
| 4,834,895 | A | 5/1989 | Cook et al. |

(Continued)

FOREIGN PATENT DOCUMENTS

| | | | |
|---|---|---|---|
| CA | 950073 | A | 6/1974 |
| CA | 1016706 | A1 | 9/1977 |
| DE | 2 350 574 | | 10/1973 |
| EP | 0 000 416 | A | 1/1979 |
| EP | 0 154 359 | A1 | 9/1985 |
| EP | 194127 | A2 | 9/1986 |
| EP | 0 258 923 | A2 | 3/1988 |
| EP | 332260 | A2 | 9/1989 |
| EP | 0 539 025 | A2 | 4/1993 |
| FR | 2175098 | A1 | 10/1973 |
| FR | 2475560 | A1 | 8/1981 |
| GB | 1 383 749 | | 10/1971 |
| GB | 1603940 | | 12/1981 |
| GB | 2 164 657 | A | 9/1985 |
| GB | 2212179 | | 7/1989 |
| JP | 53014889 | A | 2/1978 |
| JP | 61232899 | A | 10/1986 |
| JP | 02068100 | A | 3/1990 |
| JP | 03254796 | A | 11/1991 |

(Continued)

OTHER PUBLICATIONS

"Specialty Quats," A Sherex specialty technical catalog, 3 pages (undated).

*Primary Examiner*—John R Hardee
(74) *Attorney, Agent, or Firm*—Andrew D. Sorensen; Laura C. Dilorenzo; Amy J. Hoffman

(57) ABSTRACT

A fabric treatment composition is provided. The fabric treatment composition includes a fabric treatment agent and a carrier component for containing the fabric treatment agent in a solid form during operation conditions in a dryer. The fabric treatment composition is constructed for transferring the composition to wet fabric as a result of solubilizing the fabric treatment composition by contacting the fabric treatment composition with the wet fabric during a drying operation in a dryer. A method for treating fabric is provided.

30 Claims, 2 Drawing Sheets

U.S. PATENT DOCUMENTS

| | | | |
|---|---|---|---|
| 4,889,643 | A | 12/1989 | Royce et al. |
| 4,891,890 | A | 1/1990 | Church |
| 4,906,410 | A | 3/1990 | Lacke et al. |
| 4,950,412 | A | 8/1990 | Duffin et al. |
| 4,965,100 | A | 10/1990 | Leigh et al. |
| 4,977,479 | A | 12/1990 | Caroll |
| 5,020,240 | A | 6/1991 | Lee |
| 5,041,230 | A | 8/1991 | Borcher, Sr. et al. |
| 5,069,231 | A | 12/1991 | Rutherford |
| 5,082,692 | A | 1/1992 | Cavill |
| 5,102,564 | A | 4/1992 | Gardlik et al. |
| 5,145,595 | A | 9/1992 | Morris et al. |
| 5,300,238 | A | 4/1994 | Lin et al. |
| 5,416,983 | A | 5/1995 | Moser |
| 5,440,976 | A | 8/1995 | Guiliano et al. |
| 5,480,567 | A | 1/1996 | Lam et al. |
| 5,503,756 | A | 4/1996 | Corona, III et al. |
| 5,658,651 | A | 8/1997 | Smith et al. |
| 5,726,143 | A | 3/1998 | Petraia et al. |
| 5,787,606 | A | 8/1998 | Bokholdt |
| 5,869,410 | A | 2/1999 | Smith et al. |
| 5,883,069 | A | 3/1999 | Childs et al. |
| 5,943,816 | A | 8/1999 | Hyatt et al. |
| 5,966,831 | A | 10/1999 | Anderson |
| 6,006,472 | A | 12/1999 | Holtkamp, Jr. |
| 6,045,861 | A | 4/2000 | Lindauer et al. |
| 6,110,886 | A | 8/2000 | Scepanski |
| 6,133,226 | A | 10/2000 | Knowlton et al. |
| 6,238,736 | B1 | 5/2001 | Smith et al. |
| 6,254,932 | B1 | 7/2001 | Smith et al. |
| 6,305,046 | B1 | 10/2001 | Kingry et al. |
| 6,528,070 | B1 | 3/2003 | Bratescu et al. |
| 6,779,740 | B1 | 8/2004 | Lentsch et al. |
| 2003/0024943 | A1 | 2/2003 | MacDonald |
| 2005/0192203 | A1 | 9/2005 | Trinh |
| 2005/0192207 | A1 | 9/2005 | Morgan, III et al. |

FOREIGN PATENT DOCUMENTS

| | | | |
|---|---|---|---|
| JP | 04002400 | A | 1/1992 |
| JP | 04348799 | A | 12/1992 |
| JP | 07100300 | A | 4/1995 |
| JP | 11164986 | A | 6/1999 |
| WO | WO 98/27191 | | 6/1998 |
| WO | WO 03/087282 | A1 | 10/2003 |
| WO | WO 03/087286 | A1 | 10/2003 |
| WO | WO 2005/026432 | | 3/2005 |

MULTIPLE USE SOLID FABRIC CONDITIONING COMPOSITIONS AND TREATMENT IN A DRYER

CROSS REFERENCE TO RELATED APPLICATION

This application is a continuation-in-part of U.S. application Ser. No. 11/401,656, filed Apr. 10, 2006, issued as U.S. Pat. No. 7,250,393 which is a divisional of U.S. application Ser. No. 10/656,854, filed Sep. 4, 2003 issued as U.S. Pat. No. 7,087,572, which is a continuation-in-part of U.S. application Ser. No. 10/120,891, filed Apr. 10, 2002, now U.S. Pat. No. 7,381,697, the entire disclosures of which are incorporated herein by reference.

FIELD OF THE INVENTION

The invention relates to fabric treatment compositions and methods for treating fabric in a dryer. In particular, the invention provides for the dispensing of a fabric treatment agent in a dryer during a drying operation. The fabric treatment agent can be applied to impart desired beneficial properties to the fabric. The fabric treatment agent can transfer from the fabric treatment composition to wet fabric in a dryer as a result of a water solubility transfer mechanism.

BACKGROUND OF THE INVENTION

Several types of dryer fabric softeners have been available. One type of dryer fabric softener is available as a dryer sheet. The dryer sheet is placed in the dryer along with wet laundry. The sheet is often a nonwoven fabric containing a solid composition that includes a fabric softener and a fragrance. During the drying cycle, the temperature increases as the laundry dries, causing the fabric softener to melt and transfer from the nonwoven sheet to the laundry. Dryer sheets are generally provided for a single use. If the dryer sheet becomes entangled with an article of laundry, excessive deposition onto that piece of laundry may result in "spotting." Spotting is the condition where concentrated fabric softener causes a dark spot on a laundry item. For certain dryer sheet products, it is believed that dispensing of the fabric softener is primarily caused by the heat of the dryer melting the fabric softener on the dryer sheet. It is believed that this mostly takes place near the end of the drying cycle when the temperature within the dryer increases.

There are other U.S. patents that describe dryer sheets containing fabric softeners. U.S. Pat. No. 3,442,692 to Gaiser; U.S. Pat. No. 3,686,025 to Morton; U.S. Pat. No. 4,834,895 to Cook et al.; U.S. Pat. No. 5,041,230 to Borcher, Sr. et al.; and U.S. Pat. No. 5,145,595 to Morris et al.

Another type of dryer fabric softener is available as a pouch containing a fabric softener composition. The pouch can be attached to the dryer drum. During the drying cycle, the increase in temperature can melt a portion of the composition inside the pouch. The melted composition then passes through the pouch and transfers to the laundry. The pouch type dryer fabric softener can be available for multiple uses. An example of the pouch type dryer fabric softener was available under the name "Free 'Soft" from Economics Laboratory of St. Paul, Minn. Examples of pouch type dryer fabric softeners are disclosed by U.S. Pat. No. 3,870,145 to Mizuno; U.S. Pat. No. 3,967,008 to Mizuno et al.; and U.S. Pat. No. 4,098,937 to Mizuno et al.

Yet another type of dryer fabric softener is disclosed in U.S. Pat. No. 7,087,572 to Hubig, et al. The dryer softener composition is in the form of a solid that, in the heat of the dryer, transfers softening agents to the fabric. U.S. Pat. No. 7,087,572 is herein incorporated by reference in its entirety. As one can readily appreciate, due to venting a dryer to the outside, the inside of a dryer is directly open to the external air. When not in use the internal temperature of a dryer often approaches the outside temperature. In extreme conditions such as is found in the winter, exterior temperatures often drop below zero degrees Fahrenheit. In contrast, when a dryer is in operation, the internal temperature is much higher and the internal fabric temperature in a consumer dryer may reach up to about 160 degrees Fahrenheit. It has been found that anything placed inside the dryer, including a solid fabric softener, is subjected to extreme temperature swings. Applicants have learned that due to such extreme temperature swings, the stability of the solid fabric softener may be compromised. The solid dryer fabric softener may crack, crumble and even separate from its attachment. Such cracking, crumbling, and separation results in reduction of the overall useful life of the solid softener and can result in yellowing of the fabric, or deposition of marks on the fabric including spotting or streaking.

It was surprisingly discovered that by adding silicone to the composition of solid dryer fabric softeners, numerous advantages resulted. The solid dryer softeners exhibited thermal stability both during manufacture and during use in a dryer. Such thermal stability resulted in increased product performance and reduced probability of cracking and crumbling during use. In addition, the silicone-enhanced solid dryer softeners imparted desirable traits on the fabrics including, but not limited to, increased softness, reduced static, reduced wrinkling, reduced yellowing, and increased absorbency. The reduced yellowing occurred both in the solid dryer softener product and in the fabrics dried in its presence. Additionally, reduced streaking and/or spotting of the softener on fabrics occurred with the addition of silicone. Moreover, no deleterious aspects were noticed upon adding silicone to the solid dryer softener composition. The dispense rates found in the solid dryer softeners remained consistent whether or not silicone was added to the composition.

While it has been known to add silicones to fabric softeners for anti-wrinkling purposes, it has not previously been known to add silicones to solid dryer softeners resulting in the above-cited attributes.

Additional fabric softener compositions are disclosed by U.S. Pat. No. 3,972,131 to Rudy et al. and U.S. Pat. No. 4,035,307 to Fry et al.

SUMMARY OF THE INVENTION

A fabric treatment composition is provided according to the invention. The fabric treatment composition includes a fabric treatment agent and a carrier component for containing the fabric treatment agent in a solid form during operation conditions in a dryer. The fabric treatment composition is constructed for transferring the composition to wet fabric as a result of solubilizing the fabric treatment composition by contacting the fabric treatment composition with the wet fabric during a drying operation in a dryer. A fabric treatment agent of the invention comprises a quaternary ammonium component and a silicone component The fabric treatment agent can include at least one of softening agents, anti-static agents, anti-wrinkling agents, dye transfer inhibition/color protection agents, odor removal/odor capturing agents, soil shielding/soil releasing agents, ultraviolet light protection agents, fragrances, sanitizing agents, disinfecting agents, water repellency agents, insect repellency agents, anti-pilling agents, souring agents, mildew removing agents, allergicide agents, and mixtures thereof. The carrier component can include at least one of ethylene bisamides, primary alkylamides, alkanolamides, polyamides, alcohols containing at least 12 carbon atoms, alkoxylated alcohols containing at least 12 carbon atoms, carboxylic acids containing at least about 12 carbon atoms, derivatives thereof, and mixtures thereof.

The composition can be provided in a form that provides for multiple use applications, and the composition can be provided in the form that provides for single use applications. The composition can be provided in the form of a block for attachment to an interior wall of a dryer, in the form of a ball for free placement within a dryer, and in the form of a pellet, a tablet, or molded unit. In addition, the composition can be provided as a laminate to a fabric to provide a dryer sheet.

A method for treating fabric in a dryer is provided according to the invention. The method includes steps of allowing fabric containing free water to contact a fabric treatment composition inside a dryer during a drying operation, and transferring the fabric treatment agent from the fabric treatment composition to the fabric as a result of solubilizing the fabric treatment agent with the free water in the fabric. The step of transferring the fabric treatment composition can substantially end when the fabric dries sufficiently to lose the free water. In addition, the rate of transfer of the fabric treatment composition can decrease as the fabric dries during the drying operation.

DETAILED DESCRIPTION OF THE INVENTION

Figure 1:
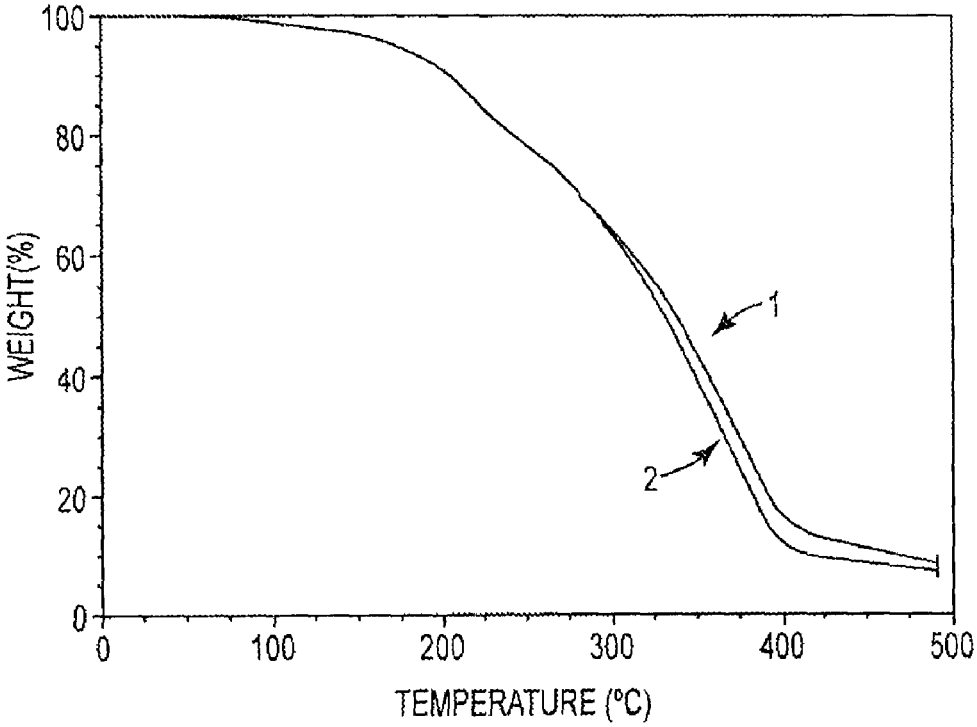
FIG. 1 is a graph depicting thermogravimetric analysis on samples containing (1) modified Varisoft DS-110 and silicone and (2) modified Varisoft DS-110 as discussed in Example 3.

Fabric treatment compositions for use in a dryer are provided by the invention. A fabric treatment composition according to the invention can be referred to more simply as a "treatment composition" or as a "composition," and can be provided in a form or shape that allows for delivery of a fabric treatment agent to fabric during the drying operation of a dryer. In general, the fabric treatment composition can remain a solid under the operating temperatures of the dryer. In addition, the fabric treatment composition can be provided as a single use or as a multiple use construction for dispensing a fabric treatment agent. It should be understood that "single use" and "multiple use" refers to the number of drying cycles in which the fabric treatment composition can be used and release an effective amount of a fabric treatment agent to fabric that is being dried during the operation of a dryer. The fabric treatment compositions can be provided for use in various types of dryers including those encountered in industrial and institutional fabric drying operations and in residential or home dryers. By the term, "industrial and institutional" it is meant that the operations are located in the service industry including but not limited to hotels, motels, hospitals, restaurants, health clubs, and the like.

The fabric treatment composition includes a fabric treatment agent and a carrier for containing the fabric treatment agent. The fabric treatment agent is the chemical component or components of the composition that imparts the desired beneficial properties to the fabric. The carrier is provided for containing and holding the fabric treatment agent in a desired shape and for facilitating transfer of the fabric treatment agent to the fabric during the drying operation. The carrier can be characterized as a dispensing carrier or a non-dispensing carrier depending upon whether the carrier transfers to the fabric. In the case of a dispensing carrier, it is expected that both the carrier and the fabric treatment agent transfer to the fabric. In the case of a non-dispensing carrier, it is expected that the fabric treatment agent transfers to the fabric without transfer of the carrier. It should be understood that a dispensing carrier can exhibit a wide range of dispensing properties. That is, large amounts or very little of the dispensing carrier can transfer to the fabric. In the context of the description of the invention, it should be understood that, unless specifically indicated, the transfer of the fabric treatment agent can include or not include transfer of the carrier. In addition, it should be understood that other components that may be present in the fabric treatment composition can be transferred along with the fabric treatment agent. In addition, multiple fabric treatment agents can transfer when they are present in the fabric treatment composition.

It is believed that the fabric treatment agent and/or the fabric treatment composition will transfer to wet fabric during a drying operation as a result of contact between the wet fabric and the fabric treatment composition. Without being bound by theory, it is believed that transfer occurs as a result of solubilizing the fabric treatment agent and/or the fabric treatment composition. The solubilized fabric treatment agent and/or fabric treatment composition transfers to the wet fabric as a result of contacting the wet fabric. As the fabric dries, it is expected that the rate of transfer decreases. It is believed that the primary mechanism for transfer of the fabric treatment agent and/or the fabric treatment composition is solubility as a result of the presence of water in the fabric during a drying operation. The temperature within the dryer may assist in solubilizing the fabric treatment agent and/or the fabric treatment composition. In addition, it is expected that in certain circumstances some amount of the fabric treatment agent and/or the fabric treatment composition may rub off onto the fabric and it is possible that a certain amount of the fabric treatment agent and/or the fabric treatment composition may transfer to the fabric by a mechanism other than by solubilizing onto the wet fabric. Nevertheless, it is expected that the water in the fabric will facilitate and will be primarily responsible for transferring the fabric treatment agent and/or the fabric treatment composition to the fabric. Applicants base this theory on their observation that running dry towels in a dryer in the presence of an exemplary fabric treatment composition resulted in negligible transfer of the fabric treatment composition to the dry towels.

It is expected that the fabric treatment composition will generally resist melting during operating conditions in the dryer so that melt transfer of the fabric treatment composition to the fabric will be relatively small, if it exists at all, and will likely not be a primary mechanism for transfer to the fabric. Once the fabric inside the dryer is considered dry, and there is no remaining free water to solubilize the fabric treatment agent and/or the fabric treatment composition, and it is expected that there will be substantially no transfer of the fabric treatment agent and/or the fabric treatment composition to the fabric by a solubility mechanism. It is possible that there may be some transfer as a result of a rubbing or friction between the fabric and the fabric treatment composition depending upon the components selected for the fabric treatment composition and the operating temperature in the dryer. The composition of the invention is a solid at room temperature wherein room temperature is between 50 and 60 degrees F.

Fabrics that can be processed according to the invention include any textile or fabric material that can be processed in a dryer for the removal of water. Fabrics are often referred to as laundry in the case of industrial and domestic (or residential) laundry operations. While the invention is characterized in the context of treating "fabric," it should be understood that items or articles that include fabric can similarly be treated. In addition, it should be understood that items such as towels, sheets, and clothing are often referred to as laundry and are types of fabrics. Additional laundry items that can be treated by the fabric treatment composition include athletic shoes, accessories, stuffed animals, brushes, mats, hats, gloves, outerwear, tarpaulins, tents, and curtains.

U.S. application Ser. No. 10/120,891 was filed with the United States Patent and Trademark Office on Apr. 10, 2002 describes, among other things, fabric softener compositions and methods for manufacturing and using fabric softener compositions. The fabric softener compositions according to U.S. application Ser. No. 10/120,891 can be used in a dryer for the delivery of a fabric softener agent, and other components, to fabric in a dryer. U.S. application Ser. No. 10/120,891 includes a description of a fabric softener composition that includes a carrier that can be characterized as a dispensing carrier, and a fabric softener agent that can be considered a fabric treatment agent where the benefit of the fabric softener agent is the softening of fabric. The entire disclosure of U.S. application Ser. No. 10/120,891 is incorporated herein by reference.

U.S. application Ser. No. 10/656,854 was filed with the United States Patent and Trademark Office on Jun. 19, 2006 describes, among other things, fabric softener compositions and methods for manufacturing and using fabric softener compositions. The fabric softener compositions according to U.S. application Ser. No. 10/656,854 can be used in a dryer for the delivery of a fabric softener agent, and other components, to fabric in a dryer. U.S. application Ser. No. 10/656,854 includes a description of a fabric softener composition that includes a carrier that can be characterized as a dispensing carrier, and a fabric softener agent that can be considered a fabric treatment agent where the benefit of the fabric softener agent is the softening of fabric. U.S. application Ser. No. 10/656,854 is herein incorporated by reference in its entirety for all purposes.

The dryers in which the fabric softener composition according to the invention can be used include any type of dryer that uses heat and/or agitation and/or air flow to remove water from the laundry. An exemplary dryer includes a tumble-type dryer where the laundry is provided within a rotating drum that causes the laundry to tumble during the operation of the dryer. Tumble-type dryers are commonly found in residences and in commercial and industrial laundry operations.

The fabric treatment composition is provided for releasing an effective amount of the fabric treatment agent to the laundry during a drying cycle in a dryer to provide the desired beneficial property or properties to the fabric or item or article being treated. It is believed that the effective amount of the fabric treatment agent is transferred primarily as a result of solubility by contacting the wet laundry and the fabric treatment composition in the dryer, and that as the fabric becomes dryer and there is less free water in the fabric, the rate of transfer as a result of solubilizing the fabric treatment agent and/or fabric treatment composition will decrease. It is expected that the transfer can be essentially stopped once the fabric becomes sufficiently dry. The exact mechanism of the transfer is not precisely known, but it is believed that the transfer is likely the result of the wet laundry solubilizing a portion of the fabric treatment composition and/or a rubbing off of a portion of the fabric treatment composition onto the wet laundry as the wet laundry contacts the fabric treatment composition during the tumbling operation in a dryer. As the laundry dries, it is expected that less of the fabric treatment agent and/or the fabric treatment composition will transfer to the laundry. It should be understood that there may be relatively small or amounts of transfer after the fabric dries, but it is expected that this amount of transfer, if it occurs at all is insufficient to impart the desired beneficial properties to the fabric. Because of this decrease of transfer, the fabric treatment composition can be characterized as a "smart composition." By dispensing by moisture control, it is possible to avoid overdosing that may result if the composition were to transfer by melting. This is in contrast to the expected operation of certain commercial dryer sheets that are believed to be temperature activated. In the case of certain temperature activated dryer sheets, it is expected that a softening agent is released when the laundry is relatively dry and the temperature within the dryer achieves a certain temperature. In addition, the transfer continues until the softening agent is completely released from the dryer sheet or until the drying operation is interrupted.

While the inventors believe that the fabric treatment agent and/or the fabric treatment composition transfers to fabric as a result of solubility in water, it should be understood that this is the Applicants' theory and other mechanisms may explain the transfer. Nevertheless, it should be recognized that the Applicants observe a rate of transfer that decreases as the fabric dries.

The Fabric Treatment Composition

The fabric treatment composition includes a fabric treatment agent or component and a carrier component. The fabric treatment agent is generally responsible for providing or imparting the various beneficial properties to the fabric. The carrier component mixes with the fabric treatment agent and helps the fabric treatment agent resist transfer to fabric or laundry by melting during the drying operation. The carrier component can be chosen so that the fabric treatment composition exhibits a melting point or softening point that is above the operating temperature of the dryer.

It is expected that industrial or commercial dryers operate at air temperatures that typically heat the fabric to a temperature in the range of between about 190 degrees Fahrenheit and about 240 degrees F., and home or residential dryers often operate at air temperatures that heat the fabric between about 120 degrees F. and about 160 degrees F. Fabric temperature is obtained by placing a temperature monitoring strip into a damp pillowcase. Temperature monitoring strips are sold as Thermolabel™ available from Temperature Indicating Devices. The pillowcase is then placed into a tumble dryer with a load of damp laundry. Once the load is dry, the temperature monitoring strip is removed from the pillowcase and the maximum recorded temperature is the maximum fabric temperature.

It should be understood that the temperature of the home or residential dryer can often be changed depending upon the item being dried. It is sometimes desirable to run the home dryer at room temperature (about 50 degrees F. to about 60 degrees F.) in situations where, for example, fluff is desired. As a result, the fabric treatment composition can be provided having a melting temperature or softening temperature that is relatively low but exceeds the intended operating temperature of the dryer. In the case of a fabric treatment composition intended for use in a commercial dryer, the melting temperature and softening temperature can be provided in excess of 240 degrees F. In the case of a fabric treatment composition intended for use in a home or residential dryer, the fabric treatment composition can be provided having a melting temperature or softening temperature in excess of 160 degrees F. It should be understood that if the fabric treatment composition is intended to be used in a home or residential dryer that is intended to operate on a fluff cycle, the melting temperature or softening temperature can be provided in excess of 70 degrees F. In many applications, it is expected that the melting temperature of the fabric treatment composition will be above about 90 degrees C. The melting temperature of the fabric treatment composition can be above about 95 degrees C., above about 100 degrees C., above about 110 degrees C., or above about 120 degrees C. In addition, the melting temperature of the fabric softener composition can be below about 200 degrees C.

The melting temperature of the fabric treatment composition refers to the temperature at which the composition begins to flow under its own weight. As the fabric treatment composition reaches its melting point, one will observe the composition undergoing a transfer from a solid discrete mass to a flowable liquid. Although a differential scanning calorimeter (DSC) measurement of the composition may reveal that certain portions or phases of the composition may exhibit melting at temperatures that are within the operating temperatures of a dryer, it should be understood that what is meant by the melting temperature of the composition is not the melting temperature of certain portions or phases within the composition, but the melting temperature of the composition as demonstrated by the composition being visibly observed as a flowable liquid. It is expected that the fabric treatment composition may be provided as a solid mixture including multiple phases or as a solid solution including a single phase. The softening temperature of the composition refers to the temperature at which the solid mass becomes easily deformable. For many exemplary compositions according to the invention, it is expected that the softening temperature will be a few degrees below the melting temperature.

The fabric treatment composition of the invention exhibits an increased melt temperature over previously known solid fabric treatment dryer compositions. It is believed that the increased melt temperature contributes to the thermal stability of the composition. One might expect the softening ability of the composition to decrease with an increased melt temperature. That is not the case. The compositions of the invention exhibit improved softening, improved anti-yellowing, and improved anti-static characteristics as compared to the lower melt temperature compositions. In addition, less streaking and/or spotting of fabrics is observed with compositions of the invention.

The fabric treatment component can include any component that, when melt mixed with the carrier component, provides a fabric treatment composition that resists melting during operation of the dryer, and that provides desired beneficial properties to fabric or laundry as a result of its presence when used during the operation of drying wet laundry in a dryer. The fabric treatment agent can be applied to fabric in a dryer to impart various beneficial properties to the fabric. Exemplary beneficial properties include softening, anti-static, anti-wrinkling, dye transfer inhibition/color protection, odor removal/odor capturing, soil shielding/soil releasing, ultraviolet light protection, fragrance, sanitizing, disinfecting, water repellency, mosquito repellency, anti-pilling, souring, mildew removing, bleaching, allergicide properties, and combinations thereof.

The fabric treatment agent can include a fabric softener agent or component when it is desired to impart fabric softening properties to the fabric. Exemplary fabric softener agents include those described in U.S. application Ser. No. 10/120,891. Exemplary components that can be used as the fabric softener agent include those fabric softeners that are commonly used in the laundry drying industry to provide fabric softening properties.

Quaternary Ammonium Component

A fabric softening agent or component of the fabric treatment agent of the invention is referred to as a quaternary ammonium compound. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, an alkyl group, a benzyl group, an alkyl ether propyl group, hydrogenated-tallow group, coco group, stearyl group, palmityl group, and soya group. Exemplary ring or cyclic quaternary ammonium compounds include imidazolinium quaternary ammonium compounds and are available under the name Varisoft®. Exemplary imidazolinium quaternary ammonium compounds include methyl-1 hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis (2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477. Exemplary alkoxylated quaternary ammonium compounds include methyl-dialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Accosoft® available from Stepan or Varisoft® available from DeGussa. Exemplary amidoamine quaternary ammonium compounds that can be used according to the invention are methyl-bis(tallow amidoethyl)-2-hydroxyethyl ammonium methyl sulfate, methyl bis(oleylamidoethyl)-2-hydroxyethyl ammonium methyl sulfate, and methyl bis(hydr.tallowamidoethyl)-2-hydroxyethyl ammonium methyl sulfate. Exemplary ester quaternary compounds are available under the name Stephantex™.

Modified quaternary ammonium compounds are available from DeGussa upon request. Modified quaternary ammonium compounds particularly useful for the present invention have modified —R groups that increase the melt temperature of the compound. Additionally, such modified quaternary ammonium compounds may have higher active components than those generally commercially available. Applicants found that Varisoft® DS-110 modified by DeGussa to increase the melt temperature was useful. The —R groups in the modified Varisoft® DS-110 were believed to include ethoxylated diamide groups.

The quaternary ammonium compounds can include any counter ion that allows the component to be used in a manner that imparts fabric-softening properties according to the invention. Exemplary counter ions include chloride, methyl sulfate, ethyl sulfate, and sulfate.

In certain compositions of this invention the amount of active quaternary ammonium component can range from about 2% to about 65%, preferably from about 4% to about 62%, by weight of the total composition, more preferably from about 6% to about 58% of the total composition. The term "active" as used herein refers to the amount of the component that is present in the composition. As one skilled in the art will recognize, many of the components of the invention are sold as emulsions and the manufacturer will provide data that includes the percentage of active ingredients to the purchaser. As a matter of example only, if 100% of a final composition is comprised of emulsion and if emulsion contains 60% of the active component X, we would say that the final composition contained 60% active component X.

Silicone Component

Another component of the fabric treatment composition of the invention is a silicone compound. While it is believed that the silicone in the composition of the invention imparts softening and increased whitening benefits to the fabrics, it is further believed that the silicone component imparts benefits to the carrier. That is, without being bound by theory it is believed that the silicone component provides stability to the solid fabric treatment composition of the invention. The stability is apparent in the reduced cracking, crumbling, powdering, and separation of the solid fabric treatment composition from the carrier. It is also believed that the silicone in the composition whitens or reduces discoloration (yellowing or browning) of the solid fabric treatment composition. The reduction in yellowing can be observed in either or both of the solid fabric treatment composition and the fabrics that are treated. It is expected that consumers will prefer a fabric treatment composition that retains its original color (such as white) and resists yellowing after several uses. The silicone of the invention can be a linear or branched structured silicone polymer and can include curable amine functional groups. The silicone of the invention can include branched or linear dialkyl polysiloxanes and/or aminoalkyl siloxanes. The silicone of the present invention can be a single polymer or a mixture of polymers.

The silicone component of the invention may be an amino functional silicone. Amino functional silicones are also referred to herein as aminosilicones. The aminosilicone of the invention can be a linear or branched structured aminosilicone polymer. The aminosilicone of the present invention can be a single polymer or a mixture of polymers, including a mixture of polymers wherein one of the polymers contains no amino functionality, e.g., a polydimethylsiloxane polymer. Suitable aminosilicones are available from Wacker and include Wacker® FC 203 which is an amino functional silicone with polyether groups. Other silicones useful in the present invention include but are not limited to Tegopren 6922 available from Degussa, CPI from Lambent, Tinotex CMA from Ciba, Y-17033=Formasil 888 from GE.

An active silicone compound is typically incorporated in the composition of the invention at a level from about 0.2 percent up to about 12 percent by weight. More preferably, the silicone component is included at a level of from about 0.5 percent to about 10 percent by weight. Most preferably, the silicone component is included at a level of from about 1 percent to about 6 percent by weight. The amino content ratio, is defined by a ratio of the amine containing units to total number of units, wherein the amino content ratio can be from about 1:10 to about 1:332.

When the fabric treatment composition includes a softening agent for providing softening properties, it is generally desirable for the fabric that is dried to remain white even after multiple drying cycles. That is, it is desirable that the fabric treatment composition not generate too much yellowing after repeated cycles of drying in the presence of the fabric treatment composition. Whiteness retention can be measured according to a whiteness index using, for example, a Hunter Lab instrument. In general, it is desirable for the fabric treated, such as 12 terry cloth towels, to exhibit a whiteness retention of at least 90% after 10 drying cycles. The whiteness retention can be greater than 95% after 10 drying cycles.

It is generally desirable for fabric treated in a dryer using the fabric treatment composition to possess a softness preference that is at least comparable to the softness preference exhibited by commercially available dryer sheets. The softness preference is derived from a panel test with one-on-one comparisons of fabric (such as towels) treated with the fabric treatment composition according to the invention or with a commercially available dryer sheet. In general, it is desirable for the softness preference resulting from the fabric treatment composition to be superior to the softness preference exhibited by commercially available dryer sheets.

The fabric treatment composition, when it includes an antistatic agent, can generate a percent static reduction of at least about 50% when compared with fabric that is not subjected to treatment. The percent static reduction can be greater than 70% and it can be greater than 80%. The test for static reduction can be carried out on 12 cotton terry towels. The antistatic properties were determined by measuring electrical charge in units of coulombs using an electrometer model 610C from Keithley Instruments. The electric charge was measured between a first cylinder having a size of 20 gallons provided within a second cylinder having a size of 31 gallons. Terry cloth towels were removed from the dryer and placed, one at a time, into the 20 gallon cylinder and the electric charge between the two cylinders was measured. It has been observed that fabric treated using the fabric treatment composition according to the invention exhibit more constant percent static reduction compared with commercially available dryer sheets.

The fabric treatment agent can include anti-static agents such as those commonly used in the laundry drying industry to provide anti-static properties. Exemplary anti-static agents include those quaternary compounds mentioned in the context of softening agents. Accordingly, a benefit of using softening agents containing quaternary groups is that they may additionally provide anti-static properties.

The fabric treatment agent can include anti-wrinkling agents to provide anti-wrinkling properties. With the hospitality industry and consumers using higher quality sheets, i.e., higher cotton content sheets, wrinkling is an increasing problem. Therefore, inclusion of anti-wrinkling agents is increasingly important in fabric treatment compositions. While the invention includes a silicone component for improved performance including increased softening, reduced yellowing, and product stability, additional silicone may be added for the purpose of an anti-wrinkling agent. Anti-wrinkling agents can include siloxane or silicone containing compounds. In addition, anti-wrinkling agents can include quaternary ammonium compounds. Exemplary anti-wrinkling agents include polydimethylsiloxane diquaternary ammonium that is available under the name Rewoquat SQ24 from DeGussa-Goldschmidt; silicone copolyol fatty quaternary ammonium that is available under the name Lube SCI-Q from Lambert Technologies; and polydimethyl siloxane with polyoxyalkylenes under the name Tinotex CMA from CIBA.

The fabric treatment agent can include odor capturing agents. In general, odor capturing agents are believed to function by capturing or enclosing certain molecules that provide an odor. Exemplary odor capturing agents include cyclodextrins, and zinc ricinoleate.

The fabric treatment agent can include fiber protection agents that coat the fibers of fabrics to reduce or prevent disintegration and/or degradation of the fibers. Exemplary fiber protection agents include cellulosic polymers.

The fabric treatment agent can include color protection agents for coating the fibers of the fabric to reduce the tendency of dyes to escape the fabric into water. Exemplary color protection agents include quaternary ammonium compounds and surfactants. An exemplary quaternary ammonium color protection agent includes di-(nortallow carboxyethyl) hydroxyethyl methyl ammonium methylsulfate that is available under the name Varisoft WE 21 CP from DeGussa-Goldschmidt. An exemplary surfactant color protection agent is available under the name Varisoft CCS-1 from DeGussa-Goldschmidt. An exemplary cationic polymer color protection agent is available under the name Tinofix CL from CIBA. Additional color protection agents are available under the names Color Care Additive DFC 9, Thiotan TR, Nylofixan P-Liquid, Polymer VRN, Cartaretin F-4, and Cartaretin F-23 from Clariant; EXP 3973 Polymer from Alco; and Coltide from Croda.

The fabric treatment agent can include soil releasing agents that can be provided for coating the fibers of fabrics to reduce the tendency of soils to attach to the fibers. Exemplary soil releasing agents include polymers such as those available under the names Repel-O-Tex SRP6 and Repel-O-Tex PF594 from Rhodia; TexaCare 100 and TexaCare 240 from Clariant; and Sokalan HP22 from BASF.

The fabric treatment agent can include optical brightening agents that impart fluorescing compounds to the fabric. In general, fluorescing compounds have a tendency to provide a bluish tint that can be perceived as imparting a brighter color to fabric. Exemplary optical brighteners include stilbene derivatives, biphenyl derivatives, and coumarin derivatives. An exemplary biphenyl derivative is distyryl biphenyl disulfonic acid sodium salt. An exemplary stilbene derivative includes cyanuric chloride/diaminostilbene disulfonic acid sodium salt. An exemplary coumarin derivative includes diethylamino coumarin. Exemplary optical brighteners are available under the names Tinopal 5 BM-GX, Tinopal CBS-CL, Tinopal CBS-X, and Tinopal AMS-GX from CIBA.

The fabric treatment agent can include a bleaching agent to whiten fabrics. With the move to lower temperature washes in order to conserve energy, bleaching during the wash cycle is increasingly ineffective. Liquid bleach generally requires water temperatures over 100 degrees Fahrenheit to be effective. Therefore, it is increasingly important to provide a dryer bleaching option. As such, bleach agents such as Eureco W-PAP; Luvicross; perborate, percarbonate, with or without bleach activators such as TAED and NOBS; or any other solid peroxygen-containing source or combinations thereof may be included in the fabric treatment composition. Bleaching agents are useful in the present invention in active amounts between about 0.01 to 20% by weight, more preferably 2 to 15% by weight, and most preferably 5 to 10% by weight.

The fabric treatment agent can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An exemplary UV protection agent includes Tinosorb FD from CIBA.

The fabric treatment agent can include an anti-pilling agent that acts on portions of the fiber that stick out or away from the fiber. Anti-pilling agents can be available as enzymes such as cellulase enzymes. Exemplary cellulase enzyme anti-pilling agents are available under the names Puradex from Genencor and Endolase and Carezyme from Novozyme.

The fabric treatment agent can include water repellency agents that can be applied to fabric to enhance water repellent properties. Exemplary water repellents include perfluoroacrylate copolymers, hydrocarbon waxes, and polysiloxanes.

The fabric treatment agent can include disinfecting and/or sanitizing agents. Exemplary sanitizing and/or disinfecting agents include quaternary ammonium compounds such as alkyl dimethylbenzyl ammonium chloride, alkyl dimethylethylbenzyl ammonium chloride, octyl decyldimethyl ammonium chloride, dioctyl dimethyl ammonium chloride, and didecyl dimethyl ammonium chloride.

The fabric treatment agent can include souring agents that neutralize residual alkaline that may be present on the fabric. The souring agents can be used to control the pH of the fabric. The souring agents can include acids such as saturated fatty acids, dicarboxylic acids, and tricarboxylic acids. Exemplary acids include those that remain solid under conditions of operation in the dryer. While it may be desirable to provide components in the fabric treatment composition that are solid during conditions of operation of the dryer, that is not necessary. It is expected that certain components may be liquid under conditions of operation in the dryer and the composition may still function as desired. Exemplary saturated fatty acids include those having 10 or more carbon atoms such as palmitic acid, stearic acid, and arachidic acid ($C_{20}$). Exemplary dicarboxylic acids include oxalic acid, tartaric acid, glutaric acid, succinic acid, adipic acid, and sulfamic acid. Exemplary tricarboxylic acids include citric acid and tricarballylic acids.

The fabric treatment agent can include insect repellents such as mosquito repellents. An exemplary insect repellent is DEET. In addition, the fabric treatment agent can include mildewcides that kill mildew and allergicides that reduce the allergic potential present on certain fabrics and/or provide germ proofing properties.

The carrier component of the fabric treatment composition can be any component that helps contain the fabric treatment component within the composition, allows the fabric treatment component to transfer to wet laundry, and provides the fabric treatment composition with a melting temperature or a softening temperature that is greater than the operating temperature of the dryer. The carrier component can be characterized as a dispensing carrier or a non-dispensing carrier depending upon whether the carrier component transfers to the wet laundry during a drying operation in a dryer. A non-dispensing carrier does not, in general, transfer to wet laundry although it allows other components in the composition to transfer to wet laundry. The dispensing carrier does transfer to wet laundry and the amount of transfer can vary depending upon the materials selected as the dispensing carrier.

The carrier component can be any component that mixes with the fabric treatment agent and forms a fabric treatment composition having a desired shape and that allows transfer of the fabric treatment agent to wet fabric during a drying operation in a dryer. The carrier component and the fabric treatment agent can be melted, mixed, and allowed to solidify to form a desired shape. Exemplary techniques for forming the composition include injection molding, casting, solution mixing, and melt mixing. It should be understood that mixing in an extruder is a form of melt mixing that occurs generally at relatively high pressures. In general, it may be desirable for the carrier component and the fabric treatment component to be soluble in each other, and sufficiently water soluble to allow water solubility induced movement of the composition to wet fabric during a drying operation in a dryer. The fabric treatment agent can be sufficient compatible with the carrier component that is can be characterized as a plasticizer for the carrier component. The carrier component can be selected to provide the fabric treatment composition as a solid during a drying operation in a dryer. Although a differential scanning calorimeter (DSC) measurement of the composition may reveal that certain portions or phases of the composition may exhibit melting at temperatures that are within the operating temperatures of a dryer, it should be understood that what is meant by the melting temperature of the composition is not the melting temperature of certain portions or phases within the composition, but the melting temperature of the composition as demonstrated by the composition being visibly observed as a flowable liquid. It is expected that the fabric softener composition may be provided as a solid mixture including multiple phases or as a solid solution including a single phase. The softening temperature of the composition refers to the temperature at which the solid mass becomes easily deformable. For many exemplary compositions according to the invention, it is expected that the softening temperature will be a few degrees below the melting temperature.

Exemplary carrier components that can be used according to the invention include fatty acid amides, ethylene bisamides, primary alkylamides, alkanolamides, polyamides, alcohols containing at least 12 carbon atoms, alkoxylated alcohols containing alkyl chain of at least 12 carbon atoms, carboxylic acids containing at least 12 carbon atoms, and derivatives thereof. Exemplary ethylene bisamides include those having the following formula:

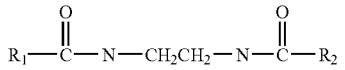

wherein $R_1$ and $R_2$ are alkyl groups containing at least 6 carbon atoms, and can be straight or branched, saturated or unsaturated, cyclic or noncyclic, and can include ethylene oxide groups and/or propylene oxide groups. $R_1$ and $R_2$ can be $C_6$ to $C_{24}$ alkyl groups. $R_1$ and $R_2$ can be the same or different. Exemplary ethylene bisamides include ethylene bis-stearamide, ethylene bispalmitamide, ethylene bisoleamide, ethylene bisbehenamide, and mixtures thereof. An exemplary mixture of ethylene bisamides includes a mixture of ethylene bis-stearamide and ethylene bis-palmitamide which can be available as a 50-50 mixture. Exemplary primary alkylamides include those having the following formula:

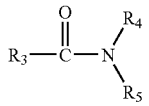

wherein $R_3$ is a $C_6$-$C_{24}$ alkyl group that may be straight or branched, saturated or unsaturated, cyclic or noncyclic, and $R_4$ and $R_5$ can be hydrogen or $C_1$-$C_{24}$ alkyl groups that are straight or branched, saturated or unsaturated, cyclic or noncyclic. $R_4$ and $R_5$ can be the same or different. An exemplary primary alkylamide is stearamide. Exemplary alkanolamides include those having the following formula:

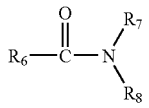

Wherein $R_6$ is a $C_6$-$C_{24}$ alkyl group that may be straight or branched, saturated or unsaturated, cyclic or noncyclic. $R_7$ and $R_8$ can be the same or different. When they are different, one can be hydrogen and the other can be an alkanol group such as $C_2H_4OH$ or $C_3H_6OH$. When they are the same, they can each be an alkanol group such as $C_2H_4OH$ or $C_3H_6OH$. Exemplary alcohols include those having the following formula:

$$R_9—OH$$

wherein $R_9$ is a $C_{12}$ to $C_{24}$ alkyl group that can be straight or branched, saturated or unsaturated, cyclic or noncyclic. Exemplary alcohols include stearyl alcohol and behenyl alcohol. Exemplary alkoxylated alcohols include those having the formula:

$$R_{10}—O(AO)_x$$

wherein $R_{10}$ is a $C_{12}$ to $C_{24}$ alkyl group that is straight or branched, saturated or unsaturated, cyclic or noncyclic, and AO is an ethylene oxide or propylene oxide group, and x is a number from 1 to 100.

Exemplary polymers that can be used as the carrier component include polyalkylenes such as polyethylene, polypropylene, and random and/or block copolymers of polyethylene and polypropylene; polyesters such as polyethylene glycol and biodegradable polymers such as polylactide and polyglycolic acid; polyurethanes; polyamides; polycarbonates; polysulfones; polysiloxanes; polydienes such as polybutylene, natural rubbers, and synthetic rubbers; polyacrylates such as polymethylmethacrylate; and addition polymers such as polystyrene and polyacrylonitrile-butadiene-styrene; mixtures of polymers; and copolymerized mixtures of polymers.

Natural or synthetic grease, or wax, or distearyl ketones, and ester waxes under the name of KAOWAX EB-P, KAOWAX EB-G, KAOWAX EB-FF or combinations thereof may also be used as the carrier component.

The carrier component can also be a carboxylic acid, carboxylic ester, a metal carboxylate such as zinc stearate, calcium stearate, magnesium stearates or combinations thereof. An organic amide or diamide, or a polyolefin could also act as the carrier component of the invention.

Additional components that can be included in the fabric softener composition include plasticizers, fragrances, and dyes. Of interest are fragrances bound to a silicone backbone. Bound fragrances have an increased staying power over conventional or non-bound fragrances.

Preparation of Composition

The fabric softener composition can be prepared by mixing the fabric softener component and the carrier component and any additional desired components at a temperature sufficient to melt all the components. The step of mixing can take place at a temperature in excess of about 100 degrees C. In general, the components should not be mixed at a temperature that is so high that it harms or discolors the components of the composition. For many components of the fabric softener composition, the mixing temperature can be less that about 180 degrees C. An exemplary range for mixing is between about 120 degrees C. and about 150 degrees C. Once the components are sufficiently mixed, the composition is shaped to provide a desired form. The form can be provided as a solid unitary structure.

Solid Form

The fabric treatment composition can be provided in a variety of solid forms. The fabric treatment composition can be constructed in a form that allows it to provide "single use" dispensing. That is, it is expected that a single use composition will be added each time the dryer is run through a drying cycle, and the amount of fabric treatment agent in the composition will be an amount sufficient to impart the desired beneficial properties to the fabric or laundry being treated in the dryer. The fabric treatment composition can be constructed in a form that provides for "multiple uses." It should be understood that multiple uses refers to the ability to dispense sufficient amounts of the fabric treatment agent during multiple cycles in a dryer. It should be understood that multiple cycles refers to at least 2 cycles. For most multiple use compositions, it is expected that they will be capable of dispensing a sufficient amount of the fabric treatment agent for at least about 5 cycles, at least about 10 cycles, at least about 50 cycles, and at least about 80 cycles. In addition, multiple use compositions can be provided that are capable of dispensing a sufficient amount of the fabric treatment agent up to about 200 cycles, up to about 150 cycles, or up to about 100 cycles. Exemplary ranges of cycles include about 2 to about 200, about 50 to about 150, and about 80 to about 100. In industrial applications, it is expected that it may be desirable to provide between about 50 cycles and about 150 cycles. In the context of residential or home use, it is expected to be desirable to provide between about 30 cycles and about 60 cycles.

Exemplary shapes for the fabric treatment composition include blocks, pellets, sheets, and balls. It is expected that these various shapes can all provide either single use applications or multiple use applications. It is expected that the blocks and the balls will be more readily adapted for multiple uses. In the case of a ball, it is expected that the ball will be placed freely inside the dryer to contact the fabric and laundry and will be removed from the dryer along with the fabric and laundry at the end of the drying cycle. The ball can then be retrieved and reused in a subsequent drying cycle. It is expected that the block will be provided attached to structure within the dryer. Exemplary structure that the block can be attached to is a dryer fin. It should be understood that a strip can be considered a form of a block. As the wet fabric or laundry contacts an exposed surface of the fabric treatment composition, it is expected that the fabric treatment agent and/or the fabric treatment composition will solubilize and transfer to the fabric or laundry. Exemplary cradles that can be used to hold the fabric treatment composition in place in the dryer include cradles such as those disclosed in U.S. Pat. No. 6,883,723 filed with the United States Patent and Trademark Office on Apr. 10, 2002; U.S. Pat. No. 6,779,740 filed with the United States Patent and Trademark Office on Apr. 9, 2003; and U.S. Pat. No. 6,910,640 filed with the United States Patent and Trademark Office on Sep. 4, 2003. Each of these three patents is incorporated herein by reference in its entirety for all purposes.

The Applicants believe that the pellets and the sheets are more readily adapted for single use applications. That is, the pellets and the sheets can be placed in a dryer in contact with the wet fabric or laundry and removed after the drying operation is complete. In the case of a pellet, it is expected that the pellet may completely disintegrate as a result of it becoming solubilized in the wet fabric or laundry. It is expected that pellets can be provided as a result of extrusion. In addition, other single use shapes can be provided including tablets and relatively small units that can be prepared from other techniques including casting or molding. In the case of a dryer sheet, it is expected that the fabric treatment composition will be provided on a substrate and that the substrate will be removed at the end of the drying cycle. The substrate may or may not have any fabric treatment composition remaining thereon at the end of the drying cycle. The substrate for a dryer sheet can be any substrate that will function in forming a drying sheet including woven and nonwoven materials.

Exemplary configurations of a fabric treatment composition according to the invention include a half-cylindrical narrow shape and a high dome. An exemplary product can be characterized as having a 1.75 inch width and a 1 inch height. Another exemplary configuration of a fabric treatment composition can be characterized as having a half-cylindrical narrow shape and a high dome with rounded top edges. The width can be provided as 1.75 inches and the height can be provided as 1 inch. Yet another exemplary configuration of a fabric treatment composition may have a half-cylindrical wide shape and a low dome. The width can be 2.5 inches and the height can be 0.65 inches. Any of the exemplary configurations may have rounded top edges. The product can have a width of 2.5 inches and a height of 0.65 inches.

Exemplary forms include blocks or strips that can be placed within a drying machine so that a surface of the fabric softener composition is exposed to laundry during the drying operation. Exemplary forms include a rectangular block and a rectangular strip. Additional forms include half-cylindrical shapes with the exposed surfaces and edges being curved or rounded for better dispensing. The shape of the fabric softener composition can be used to control dispensing of the fabric treatment agent. For example, it has been observed that the presence of sharp edges that contact fabric during a drying operation in a dryer may have a tendency to deliver more fabric treatment agent and/or fabric treatment composition to the fabric until the edges become worn down compared with an otherwise identical fabric treatment composition that contains curved or rounded edges. Accordingly, the shape of the fabric treatment composition can be used to deliver more of a certain fabric treatment agent to fabric during early stages. For example, when a fabric treatment composition is new, it may be desirable to include water repellent agents in the edge portions of the fabric treatment composition with the expectation that fabric treated by new fabric treatment composition will receive a higher dose of water repellent agents. Accordingly, the fabric treatment composition can include multiple fabric treatment agents provided at different locations within the fabric treatment composition as desired to control the stage at which certain fabric treatment agents become released.

The fabric treatment composition can be placed on an interior wall of a dryer so that the fabric treatment composition contacts the laundry or items inside the dryer that are being dried. The interior wall can be a fin of the dryer or it can be some other wall. For example, the interior wall can be a door, an end wall, and a glass window.

The fabric treatment composition can have a variety of sizes. The sizes may differ depending upon the fabric treatment agent provided within the composition. For example, the fabric treatment composition can be provided as a fabric softener composition having a size of at least about 5 grams. When the fabric softener composition is provided having a size of at least about 5 grams, it is expected that it will provide fabric softening and/or antistatic properties for laundry in multiple cycles of a dryer. An exemplary size is about 30 g to about 170 g. It is expected that the fabric softening composition can have different sizes depending upon whether it is intended to be used in an industrial drying operation or it is intended to be used in a consumer or residential dryer. In the case of an expected use in an industrial dryer, it is expected that the fabric softening composition will have a size of between about 150 grams and about 400 grams. When it is expected to be used in a consumer or home dryer, it is expected that the fabric softener composition will have a size of between about 30 grams and about 100 grams. A reason for a size difference between industrial use and residential use relates to the size of industrial and residential dryers. There is generally more room inside an industrial dryer to provide a larger fabric softener composition compared with a residential dryer. In the case of an industrial application, it is expected that the composition can have between about 50 cycles and about 150 cycles before replacement. In the case of residential use, it is expected that the composition can have between about 30 cycles and about 60 cycles before replacement. Although the above discussion focused on the size and the number of cycles for the fabric softener composition, it should be understood that the discussion additionally applies to the fabric treatment composition.

The fabric treatment composition includes a sufficient amount of the fabric treatment agent so that the composition releases a desired amount of the fabric treatment agent during a drying cycle to impart the desired beneficial properties to the fabric being dried. In general, it is desirable for the composition to release a sufficient amount of the fabric treatment agent to provide the desired beneficial properties and it is desirable not to release too much that could create waste or adversely affect the fabric. It is expected that the ratio of the fabric treatment component to the carrier component will vary depending upon the fabric treatment agent and the carrier component and the desired level of transfer of either or both of the fabric treatment agent and the carrier component. In a preferred embodiment, the fabric treatment active component is sufficiently high to impart desirable attributes to the laundry while maintaining a sufficiently high melt temperature for the solid fabric treatment composition such that the composition does not melt and deposit on laundry during use and so that the deposit of the composition occurs slowly enough for extended use if that is desired.

In the case of a fabric treatment composition that includes a fabric softener agent, the fabric softener agent and the carrier component can be mixed together to provide a fabric softener composition that releases a desired amount of fabric softener component during the drying cycle when placed inside of a dryer. The weight ratio of the fabric softener component to the carrier component can be greater than about 1:19 and can be greater than about 1:10. The ratio of the fabric softener component to the carrier component can be less than about 19:1, and can be less than about 10:1. An exemplary weight ratio of fabric softener component to carrier component is between about 1:19 to about 19:1. The ratio of the fabric softener component to the carrier component can be between about 1:10 and about 10:1, and can be between about 3:7 and about 9:1. It should be understood that the reference to the fabric softener component refers to the component responsible for providing fabric-softening properties, and is not meant to include the medium that may be present with the fabric softener component. That is, the fabric softener component may be commercially available in a medium that can be a solvent or a surfactant. Furthermore, the medium can be the same as or different from the carrier component. Although the above discussion focuses on the weight ratio of the fabric softener component to the carrier component, it should be understood that the same ratios can be applied to the fabric treatment component and the carrier component.

During the drying cycle, the fabric treatment composition should release a sufficient amount of the fabric treatment agent to provide a desired level of beneficial properties to the fabric. The amount of the fabric treatment agent that is released can be designed so that it depends on the fabric treatment agent and the amount of the agent needed to provide the desired beneficial properties. When it is desirable to provide UV protection and optical brightening, it is expected that about $10^{-6}$ to about $10^{-3}$ grams per pound of dry linen will be released. When it is desirable to provide fragrance to the fabric, it is expected that about $10^{-4}$ to about $10^{-2}$ grams per pound of dry laundry will be released, and when it is desired to provide softening, anti-wrinkling, color protecting and soil releasing properties, it is expected that about $10^{-3}$ to about 1 gram per pound of dry linen will be released.

When the fabric treatment composition is used during a drying cycle, it is expected that the amount of the composition that will transfer to the fabric will depend on the fabric treatment agent and the carrier component. In the case of non-dispensing carriers, it is expected that the amount of the composition that is transferred to the wet fabric may be the same as the amount of the fabric treatment agent that is transferred to the fabric. It should be understood that additional components may be present in the fabric treatment composition that may transfer to the fabric. In the case of dispensing carriers, it is expected that the amount of the dispensing carrier that is transferred will depend upon the dispensing carrier selected. For example, it may be desirable to select a load dispensing carrier when the fabric treatment composition includes a fabric treatment agent that can be transferred in relatively small quantities. For example, in the case of a UV protectant, an optical brightener, or a fragrance, it may be desirable to select a carrier that provides low dispensing of the carrier. A higher dispensing carrier may be selected when it is desirable to transfer larger amounts of the fabric treatment agent. For example, when the fabric treatment agent that is dispensed includes fabric softeners, anti-wrinkling agents, color protectants, and soil releasants, it is expected that the higher dispensing carriers may be selected so that the fabric treatment composition transfers about 0.01 to about 1 gram per pound of dry linen for each cycle.

During the drying cycle, the fabric softener composition should release a sufficient amount of the fabric softener composition to provide a desired level of softening properties and, if desired, antistatic properties. In addition, the fabric softener composition should not release too much of the fabric softener component that would result in spotting of the laundry. It is expected that during the drying cycle, the fabric softener composition will lose between about 0.01 to about 1.0 gram of the fabric softener composition per pound of dry laundry. The amount of loss per drying cycle can be between about 0.02 and 0.75 gram of the fabric softener composition per pound of dry laundry, and can be between about 0.05 to 0.50 gram of fabric softener composition per pound of dry laundry. In the situation where a dryer that is rated for a 30 pound capacity is used to dry laundry, the dry weight of the laundry is typically about 15 pounds. In this situation, a block of fabric softener composition having a size of about 150 grams is expected to lose about 1.5 grams per drying cycle and provide softening for 100 cycles. It should be understood that the size of the dryer and the size of the fabric softener composition can vary for different types of dryers and drying conditions. For example, there are various sizes of dryers that are commonly used in industrial laundry facilities and in residential or consumer environments. Although the above characterization of exemplary doses applies to fabric softener compositions, it should be understood that it additionally applies to the fabric treatment composition. In addition, it should be understood that various fabric treatment compositions may include higher or lower dosing per cycle depending upon the selected fabric treatment agent.

The fabric treatment composition can be designed to provide the user with a signal indicating when it is time to replace the composition with a new composition. For example, a hook and loop fastener can be embedded or placed underneath the composition. Once the composition is ready for replacement, the hook and loop fastener becomes exposed and laundry items become attached to the hook and loop fastener thereby signaling to the operator that it is time to replace the composition. In addition, a shiny material such as a foil can be embedded or placed underneath the composition. Once the composition is ready for replacement, shiny pieces of material may start falling off and becoming part of the dry fabric thereby signaling to the user that it is time to change the composition. In addition, a tag can be used similar to the shiny material so that the tag falls off and becomes a part of the dried fabric. The user or a subsequent handler of the dried fabric will read the tag that signals to the user that the composition should be replaced.

Applications

Although the fabric treatment composition can be used to impart certain beneficial properties to fabrics or laundered items during the drying operation in a dryer, the fabric treatment composition can be used to impart certain benefits further downstream. For example, in housekeeping areas, delivery of an anti-static agent to a dust cloth or mop may assist in the removal of dust when the cloth or mop is used. In addition, a polishing agent can be imparted to a cloth or polishing substrate to assist with polishing an article. In the vehicle care industry, water repellents and/or static control agents may be applied to substrates in a dryer to allow those substrates to impart those materials to a vehicle surface.

The fabric treatment composition can be provided with a variety of suggested shapes to help the user understand how the fabric treatment composition can be used. For example, in a situation where the fabric treatment composition is used to impart an insect repellent to fabric, the composition can be provided in the form of a bug.

EXAMPLE 1

Four fabric softener compositions for use in a dryer to provide anti-yellowing and softening properties are presented in Table 1. The compositions are provided as solids exhibiting a melting point above 100 degrees C. The compositions of Formula C and Formula D are prepared according to the invention. That is, these formulae include a quaternary ammonium component and a silicone component. Formula A is provided as a control containing only a quaternary ammonium component. Formula B contains a higher concentration of active quaternary ammonium compound. The quaternary ammonium compound used in Formula B is an unmodified quaternary ammonium. Formula C contains an unmodified quaternary ammonium along with a silicone component. Formula D contains a modified quaternary ammonium along with a silicone component.

TABLE 1

| Component trade name | Chemical composition | Formula A (CONTROL) % by weight | Formula B % by weight | Formula C % by weight | Formula D % by weight |
|---|---|---|---|---|---|
| Acrawax | Ethylene bis-stearmide | 40.50 | 40.50 | 32.50 | 32.50 |
| Varisoft DS-110 | Dimethyl Sulfate-Quaternary ammonium | 43.00 | 52.00 | 52.00 | — |
| Varisoft DS-110 Modified | Dimethyl Sulfate-Quaternary ammonium R = diamide ethoxylated | — | — | — | 48.00 |
| Luwax AL61 | Ethylene, homopolymer | 10.00 | 4.00 | 2.00 | 2.00 |

TABLE 1-continued

| Component trade name | Chemical composition | Formula A (CONTROL) % by weight | Formula B % by weight | Formula C % by weight | Formula D % by weight |
|---|---|---|---|---|---|
| Luwax OA5 | Ethylene, homopolymer, oxidized | 5.00 | 2.00 | 1.00 | 2.00 |
| Mountain Fresh | Fragrance | 1.50 | 1.50 | 1.50 | 1.50 |
| Varisoft DS-100 Modified | Dimethyl Sulfate-Quaternary ammonium R = dehydrogenated tallow ~75% active quaternary ammonium, ~30% anti-wrinkle aid | — | — | — | 10.00 |
| Hydrosoft (Rhodia) | Amino polydimethyl siloxane | — | — | 4.00 | 4.00 |

Preliminary dispensing rates of the fabric softening compositions of Formulae A, B, and C from Table 1 were obtained and are shown in Table 2. In each test, the fabric treatment composition is coated on a plastic carrier which is then locked into place on a dispenser adhered on the dryer fin. Average dispensing rate was obtained by weight difference after multiple standard wash and dry cycles with 30 lb dry weight terry towels. Each dry cycle was 60 minutes with an average fabric temperature of 210 degrees F.

EXAMPLE 2

Dispensing Data for Dryer Strip of Formulae A, B, and C

A desired amount of the fabric treatment composition to provide fabric softening properties can be released during the drying cycle. In this example, cumulative dispensing of the product was measured by weight loss as shown in the table below.

TABLE 2

| Cycle # | Formula A % Wt. Loss | Formula B % Wt. Loss | Formula C % Wt. Loss |
|---|---|---|---|
| 4 | 15.4 | 17.3 | 10.2 |
| 8 | 24.6 | 26.8 | 17.4 |
| 12 | 30.5 | 32.8 | 23.7 |
| 16 | 35.4 | 36.9 | 29.3 |
| 20 | 40.9 | 41.8 | 34.5 |
| 24 | 45.6 | 46.7 | 39.2 |
| 28 | 50.1 | 50.2 | 43.8 |
| 32 | 53.3 | 53.5 | 47.4 |
| 36 | 56.6 | 56.8 | 50.1 |

The average grams active softening agent (quaternary ammonium and siliocone components) per grams linen per drying cycle can be calculated as follows:

If the dose is 7.9 g×52.45% actives=4.14 g actives 4.14 g actives=0.25 g per towel 16 towels 0.25 g×1 towel=0.00049×1000=0.49 g actives per g linen towel 510 g The percent by weight actives for each formula is shown in the table below.

TABLE 3

| FORMULA PERCENT SOFTENING "ACTIVES" | | | |
|---|---|---|---|
| Formula A (CONTROL) % by weight | Formula B % by weight | Formula C % by weight | Formula D % by weight |
| 32.68 | 39.52 | 43.52 | 52.6 |

EXAMPLE 2

Stability

Solid dryer fabric treatment compositions having the compositions of Formulae A, B, and C as provided in Table 1 were placed in dryers. The solid composition of Formula A (Control) exhibited cracking and crumbling issues after approximately 10 cycles whereas the solid compositions of Formulae B and C did not exhibit the same cracking and crumbling issues. A "crack" or "cracking", for the purposes of this invention, is defined as any fissure having a width of at least 2-3 mm or any solid that includes fissures having at least 2-3 mm width. The compositions of the invention therefore provide greater product stability as compared to the control.

Cracking resulted in Formula A compositions whereas the compositions including a modified quaternary ammonium or silicone demonstrated substantially less cracking. Field Test results are summarized in the table below.

TABLE 4

| | Formula A | Formula B | Formula C |
|---|---|---|---|
| Cracking and crumbling after 8 weeks | Chronic cracking and crumbling in >80% of samples | Minimal cracking <2% had fissures | Minimal cracking <1% had fissures |
| Test timing and location | April-May in Minnesota | January-February in Minnesota | February-March in Minnesota |

Formulae B and C samples were field tested during very cold months resulting in the largest temperature swings possible. Even under the harshest conditions, the samples of the invention performed for better than the control of Formula A.

Formula A performed poorly in much gentler conditions with far less temperature swings of April in Minnesota.

The solid dryer fabric treatment compositions having modified or unmodified actives and silicone show greater thermal stability, which is directly correlated to the performance under extreme conditions in the dryer. Thus reducing the overall cracking and crumbling issues of past compositions.

EXAMPLE 3

Thermogravimetric Analysis

Figure 2:
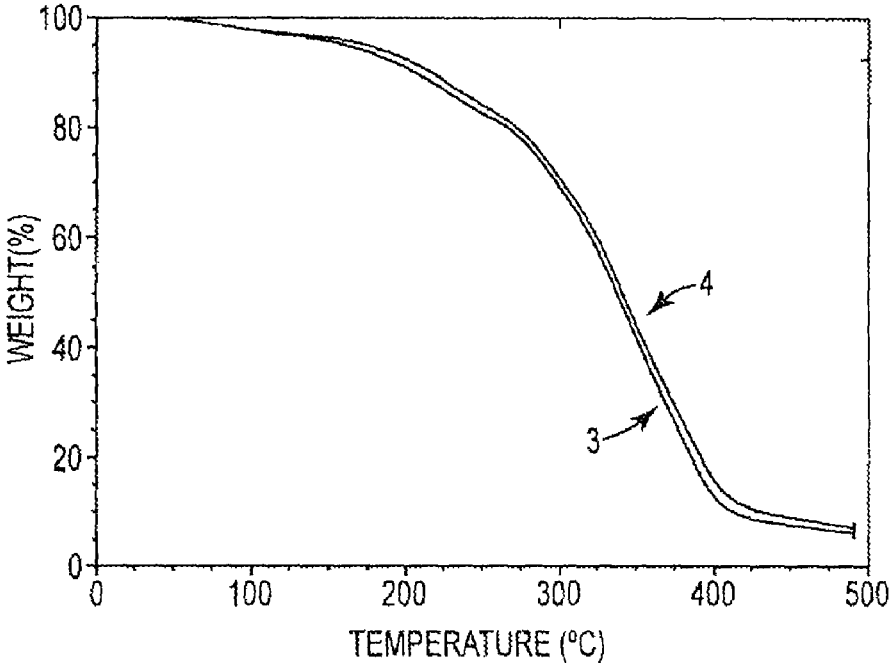
FIG. 2 is a graph depicting thermogravimetric analysis on samples containing Varisoft DS 110 (3), and Varisoft DS 110 and silicone (4).

Thermogravimetric analysis was conducted on samples containing (1) modified Varisoft DS-110 and silicone, (2) modified Varisoft DS-110, (3) Varisoft DS 110, and (4) Varisoft DS 110 and silicone. The samples were heated slowly from 0° C. to 500° C. The percent solids remaining at each temperature is shown in the graph below. The silicone addition provided greater percent solid remaining in the sample as compared to without silicone. See FIGS. 1 and 2.

EXAMPLE 4

Softness

Solid dryer fabric treatment compositions having the compositions of Formulae B and C as provided in Table 1 were placed in dryers. Towels were tested for initial softness and had initial softness results of between 0 and 1 on a scale from 0 (not soft) to 4 (softest). Softness was determined by rating from a panel of trained experts. After a few weeks, the towels had softness results of about 2. After 8 weeks of testing, the towels had a softness rating of 3 to 4. Beginning in week 9, the fabric treatment compositions of the invention were removed from the dryers and replaced with Formula A compositions. By the end of week 12, all towels had decreased in softness to between 0 and 1.

EXAMPLE 5

Softness

Solid dryer fabric treatment compositions having the compositions of A and B as provided in Table 1 were placed in dryers. Softness was determined by rating from a panel of trained experts. A paired comparison test was conducted. Each sample was compared against a control. Softness of the sample was either equivalent to the control, preferred, or not preferred as compared to the control. Softness was said to not decrease as compared to the control if softness was equivalent or preferred as compared to the control. In every instance, the towels dried in the presence of Formula B was preferred to that dried in the presence of Formula A.

EXAMPLE 6

Raw Material Melting Temperatures

DSC Analysis was conducted on raw materials. The raw materials included a combination of Varisoft DS-110 (unmodified quaternary ammonium) and Silicone (Sample 1); Modified Varisoft DS-110 and Silicone (Sample 2); Varisoft DS-110 (unmodified quaternary ammonium) (Sample 4); and Modified Varisoft DS-110 (Sample 3). Results are shown as melting temperature ranges in Table 5 below:

TABLE 5

| Sample # | Raw Material(s) | Initial Temperature (degrees C.) | Final Temperature (degrees C.) |
|---|---|---|---|
| 1 | Varisoft DS-110 and Silicone | 38 | 53 |
| 2 | Modified Varisoft DS-110 and Silicone | 57 | 65 |
| 3 | Modified Varisoft DS-110 | 56 | 62 |
| 4 | Varisoft DS-110 | 30 | 44 |

The melting temperature ranges demonstrate that melting temperature increases when modifying the quaternary ammonium or when adding silicone or when combining a modified quaternary ammonium with silicone.

EXAMPLE 7

Composition Melting Temperatures

Formulae A, B and C were prepared according to Table 1 above. A differential scanning calorimeter (DSC) analysis of each composition was completed. The initial temperature of the composition was taken. The melting temperature of the composition as demonstrated by the composition being visibly observed as a flowable liquid was taken. Results are shown in Table 6 below. This example shows that the compositions of the invention provide higher melting temperatures of the solid fabric treatment products.

TABLE 6

| DSC Analysis Ranges | | |
|---|---|---|
| Formula | Initial Melt Temp. (degrees C.) | Final Melt Temp. (degrees C.) |
| A | 35 | 44 |
| B | 38 | 52 |
| C | 57 | 55 |

EXAMPLE 8

Penetrometer Analysis

Samples having compositions prepared according Formula A, B, and C provided in Table 1 were placed in a controlled temperature oven for 60 minute intervals. After each 60 minute interval Penetrometer readings were taken. Several readings were taken and averaged. The oven temperature was increased after each 60 minute interval and the samples were placed in the oven. Each measurement reading is the distance that the penetrometer needle penetrated into the sample from the surface down, in 1/10 mm increments. Results are shown in Table 7 below. This Example shows how soft the block is at 65 degrees C. and at 93 degrees C. As shown by the results, Formulae B and C are softer than the control, Formula A, as the temperature increased.

TABLE 7

| Penetrometer Ranges | | | |
|---|---|---|---|
| TEMP | FORMULA A | FORMULA B | FORMULA C |
| 65 C. | 30 mm | 29 mm | 34 mm |
| 93 C. | 104 mm | 126 mm | 113 mm |

EXAMPLE 9

Anti-Static Analysis

Figure 3:
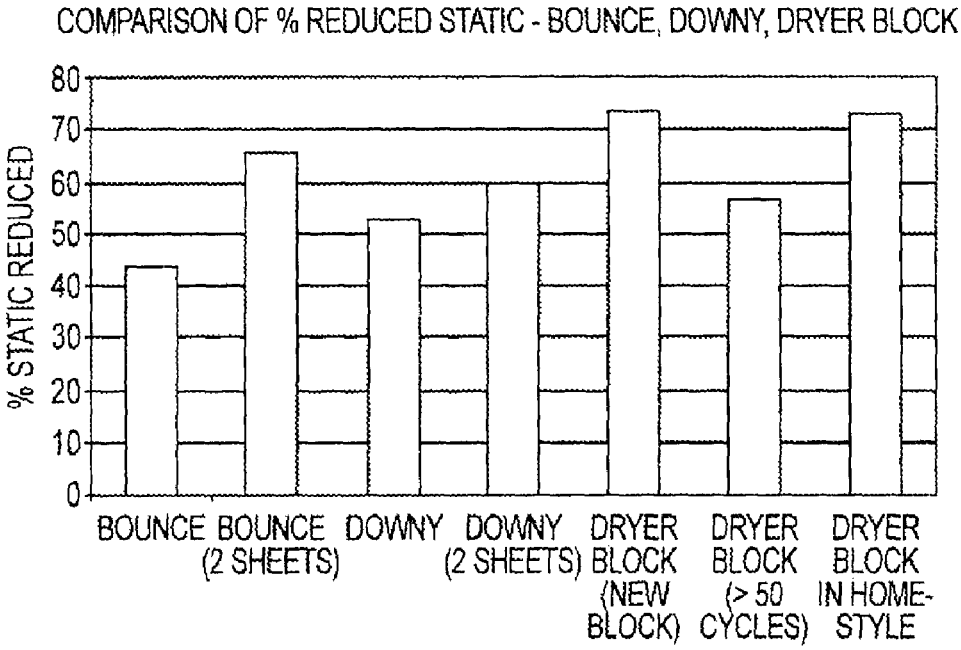
FIG. 3 is a graph comparing Percent Reduced Static in Dryer Cycle of Compositions of the Invention against Bounce and Downy brands dryer sheets.

Samples were dried in the presence of solid fabric treatment composition prepared according to Formula A provided in Table 1 above and without a fabric softener. Commercially available fabric softeners such as a softening liquid and dryer sheets were compared against Formula A. The drying cycles lasted for 60 minutes and the fabric temperature reached 220 degrees F. Static was measured using a Galvanometer placed inside a Faraday cage. Results showed that static was significantly reduced in those batches using a fabric treatment agent of the invention as compared to those without a fabric treatment agent or to those commercially available fabric softeners. See FIG. 3.

EXAMPLE 10

Block Whiteness Analysis

This Example shows that adding silicone to the composition of the invention produced whiter compositions. Fabric Treatment Compositions prepared according to Formula A, Formula C, and Formula D were analyzed with the Hunter Lab instrument to evaluate the magnitude of differences seen between the formulas. Table 8 below shows the results.

TABLE 8

| | Hunter Analysis Whiteness Ranges | | |
|---|---|---|---|
| Condition | Formula A Avg. Whiteness Level, Best = 0 | Formula C Avg. Whiteness Level, Best = 0 | Formula D Avg. Whiteness Level, Best = 0 |
| Round 1 Results - Initial | −89.28 | — | −23.99 |
| Round 1 Results - Final | −70.0 | — | −12.63 |
| Round 2 Results - Initial | −88.83 | −25.94 | — |
| Round 2 Results - Final | −142.13 | −66.09 | — |

The results show that Formula D had the whitest initial and final color. Formula C performed better than Formula A in that Formula C was whiter than Formula A both initially and in the final result.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A fabric treatment composition comprising: (a) fabric treatment agent comprising a fabric softener component comprising a quaternary ammonium compound and silicone compound; and (b) carrier component for containing the fabric treatment agent in a solid form during operating conditions in a dryer, the carrier component comprising a fatty acid amide having a melting temperature between about 110 degrees C. and 170 degrees C.; wherein the fabric treatment composition transfers to wet fabric as a result of solubilizing the fabric treatment composition by contacting the fabric treatment composition with the wet fabric during a drying operation in a dryer, and wherein the composition is provided in the form of a block at room temperature wherein the block is constructed to provide release of an effective amount of the fabric treatment agent during at least 10 drying cycles in a dryer.

2. A fabric treatment composition according to claim 1, wherein the fabric treatment agent further comprises at least one of anti-static agents, anti-wrinkling agents, dye transfer inhibition/color protection agents, odor removal/odor capturing agents, soil shielding/soil releasing agents, ultraviolet light protection agents, fragrances, sanitizing agents, disinfecting agents, water repellency agents, insect repellency agents, anti-pilling agents, souring agents, mildew removing agents, allergicide agents, and mixtures thereof.

3. A fabric treatment composition according to claim 1, wherein the fabric softener component comprises at least one of methyl bis(tallow amidoethyl)-2-hydroxyethyl ammonium methyl sulfate, methyl bis(oleylamidoethyl)-2-hydroxyethyl ammonium methyl sulfate, methyl bis(hydrogenated tallow amidoethyl)-2-hydroxyethyl ammonium methyl sulfate and mixtures thereof.

4. A fabric treatment composition according to claim 1, wherein the carrier component is comprised of an organic monomeric, dimeric, trimeric, tetrameric or polymeric compound or combinations thereof.

5. A fabric treatment composition according to claim 1, wherein the carrier component is comprised of a natural grease, wax, distearyl ketone, or an ester wax or combinations thereof.

6. A fabric treatment composition according to claim 1, wherein the carrier component is comprised of ethylene bisamide.

7. A fabric treatment composition according to claim 6, wherein the ethylene bisamide has the formula:

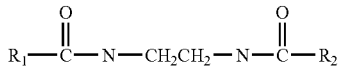

wherein $R_1$ and $R_2$ can be the same or different and each are an alkyl group containing at least 6 carbon atoms.

8. A fabric treatment composition according to claim 1, wherein the carrier component is comprised of a carboxylic acid, carboxylic ester, metal carboxylate, organic amide, organic diamide, polyolefin, or combinations thereof.

9. A fabric treatment composition according to claim 1, wherein the carrier component comprises at least one of ethylene bis-stearamide, ethylene bispalmitamide, ethylenebisoleamide, ethylene bisbehenamide, and mixtures thereof.

10. A fabric treatment composition according to claim 1, wherein the quaternary ammonium component is comprised of an amidoamine quaternary ammonium compound or an ester quaternary ammonium compound or mixtures thereof.

11. A fabric treatment composition according to claim 1, wherein the quaternary ammonium component has a melting temperature 62 degrees C. or greater.

12. A fabric treatment composition according to claim 1, wherein the composition is in the form of block constructed for attachment to an inside surface of a dryer.

13. A fabric treatment composition according to claim 1, wherein the composition has a melting temperature above 90 degrees C.

14. A fabric treatment composition according to claim 1, wherein cotton terry cloth towels, when subjected to at least 10 drying cycles in the presence of the fabric treatment composition, exhibit a whiteness retention of at least 90%.

15. A fabric treatment composition according to claim 1, wherein fabric dried in the presence of the fabric treatment composition exhibit at least a 50% static reduction compared with the fabric dried outside of the presence of the fabric treatment composition.

16. A fabric treatment composition according to claim 1, wherein the fabric treatment agent further comprises an anti-wrinkling agent comprising siloxane or silicone containing compounds.

17. A fabric treatment composition according to claim 1, wherein the fabric treatment agent further comprises an odor-capturing agent.

18. A fabric treatment composition according to claim 1, wherein the fabric treatment agent further comprises a color protection agent.

19. A fabric treatment composition according to claim 1, wherein the fabric treatment agent further comprises a soil-releasing agent.

20. A fabric treatment composition according to claim 1, wherein the fabric treatment agent further comprises an optical brightening agent comprising fluorescing compounds.

21. A fabric treatment composition according to claim 1, wherein the fabric treatment agent further comprises a UV protection agent.

22. A fabric treatment composition according to claim 1, wherein the fabric treatment agent further comprises an anti-pilling agent comprising a cellulase enzyme.

23. A fabric treatment composition according to claim 1, wherein the fabric treatment agent further comprises a water repellency agent comprising perfluoroacrylate copolymers, hydrocarbon waxes, and polysiloxanes.

24. A fabric treatment composition according to claim 1, wherein the fabric treatment agent further comprises a disinfecting and/or sanitizing agent, or a souring agent for neutralizing residual alkaline, or any combination thereof.

25. A fabric treatment composition according to claim 1, wherein the silicone is comprised of an aminosilicone, curable aminosilicones, dialkyl polysiloxanes, aminoalkyl siloxane or any combination thereof.

26. A fabric treatment composition according to claim 1, wherein the silicone is branched or linear.

27. A fabric treatment composition according to claim 1, wherein the fabric treatment agent further comprises an insect repellent.

28. A fabric treatment composition according to claim 1, wherein the composition further comprises at least one of plasticizers, fragrances, and dyes.

29. A fabric treatment composition according to claim 1, wherein the solid composition does not exhibit cracks of 3 mm or greater when placed in a dryer for 10 cycles.

30. A fabric treatment composition according to claim 1, wherein the solid composition does not exhibit cracking or crumbling when placed in a dryer for 10 cycles.

* * * * *